US008695578B2

(12) United States Patent
Olden et al.

(10) Patent No.: US 8,695,578 B2
(45) Date of Patent: Apr. 15, 2014

(54) SYSTEM AND METHOD FOR DELIVERING A PROJECTILE TOWARD A TARGET

(75) Inventors: Thomas A. Olden, Tucson, AZ (US); Robert P. Johnson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 147 days.

(21) Appl. No.: 13/335,394

(22) Filed: Dec. 22, 2011

(65) Prior Publication Data

US 2012/0298088 A1 Nov. 29, 2012

Related U.S. Application Data

(60) Provisional application No. 61/431,481, filed on Jan. 11, 2011.

(51) Int. Cl.
*F41B 11/08* (2006.01)

(52) U.S. Cl.
USPC ..... 124/57; 102/530; 42/105

(58) Field of Classification Search
USPC ..... 124/57; 102/530, 502; 42/105, 77
See application file for complete search history.

(56) References Cited

U.S. PATENT DOCUMENTS

| | | | |
|---|---|---|---|
| 2,373,364 | A | 4/1945 | Wellcome |
| 3,648,613 | A | 3/1972 | Cunn |
| 3,801,416 | A | 4/1974 | Gulbierz |
| 3,814,016 | A | 6/1974 | Leach et al. |
| 5,326,101 | A | 7/1994 | Fay |
| 5,750,918 | A | 5/1998 | Mangolds et al. |
| 5,864,767 | A | 1/1999 | Drumgoole et al. |
| 6,323,145 | B1 | 11/2001 | Popper et al. |
| 6,381,894 | B1 | 5/2002 | Murphy |
| 6,568,118 | B1 | 5/2003 | Teetzel |
| 6,626,077 | B1 | 9/2003 | Gilbert |
| 6,854,374 | B1 | 2/2005 | Breazeale |
| 6,904,838 | B1 | 6/2005 | Dindl |
| 8,186,276 | B1 | 5/2012 | Olden et al. |
| 2003/0156272 | A1 | 8/2003 | Cytron et al. |
| 2006/0086349 | A1 | 4/2006 | Kamen et al. |
| 2007/0117483 | A1 | 5/2007 | Bhatnagar et al. |
| 2007/0169616 | A1 | 7/2007 | Vickroy |
| 2008/0127598 | A1 | 6/2008 | Kallstrom |
| 2009/0266226 | A1 | 10/2009 | Beach et al. |
| 2011/0129657 | A1 | 6/2011 | Clough |

FOREIGN PATENT DOCUMENTS

| | | |
|---|---|---|
| WO | WO-2010107469 | 9/2010 |
| WO | WO-2012/097063 A1 | 7/2012 |

OTHER PUBLICATIONS

"U.S. Appl. No. 12/556,311, Non Final Office Action mailed Nov. 2, 2011", 9 pgs.
"U.S. Appl. No. 12/566,311, Restriction Requirement mailed Sep. 9, 2011", 5 pgs.

(Continued)

*Primary Examiner* — Michael David
(74) *Attorney, Agent, or Firm* — Schwegman, Lundberg & Woessner, P.A.

(57) ABSTRACT

Some embodiments relate to a system and method for delivering a projectile toward a target. The system includes a launcher and a propulsion system positioned within the launcher. The propulsion system includes a gas generator that produces enough gas within a certain period of time to direct the projectile from the launcher toward the target. The system for delivering a projectile may further include a targeting system that collects data regarding the location of the target. In addition, the launcher may include a venting system that exhausts a particular amount of gas from the launcher in order to direct the projectile from the launcher at a desired velocity based on data received from the targeting system.

18 Claims, 6 Drawing Sheets

(56) References Cited

OTHER PUBLICATIONS

"International Application Serial No. PCT/US2010/000629, Search Report mailed May 13, 2010", 5 pgs.
"International Application Serial No. PCT/US2010/000629, Written Opinion mailed May 13, 2010", 10 pgs.
"U.S. Appl. No. 12/556,311, Examiner Interview Summary mailed Mar. 16, 2010", 3 pgs.
"U.S. Appl. No. 12/556,311, Final Office Action mailed Feb. 10, 2010", 5 pgs.
"U.S. Appl. No. 12/556,311, Notice of Allowance mailed Mar. 25, 2010", 5 pgs.
"U.S. Appl. No. 12/556,311, Response filed Feb. 1, 2012 to Non Final Office Action mailed Nov. 2, 2011", 10 pgs.
"U.S. Appl. No. 12/556,311, Response filed Mar. 12, 2012 to Final Office Action mailed Feb. 10, 2012", 8 pgs.
"U.S. Appl. No. 12/556,311, Response filed Oct. 5, 2011 to Restriction Requirement mailed Sep. 9, 2011", 5 pgs.
"International Application Seriai No. PCT/US2012/020939, Search Report mailed May 2, 2012", 2 pgs.
"International Application Serial No. PCT/US2012/020939, Written Opinion mailed May 2, 2012", 6 pgs.

SYSTEM AND METHOD FOR DELIVERING A PROJECTILE TOWARD A TARGET

CLAIM OF PRIORITY

This patent application claims the benefit of priority, under 35 U.S.C. §119(e), to U.S. Provisional Patent Application Ser. No. 61/431,481, entitled SYSTEM AND METHOD FOR DELIVERING A PROJECTILE TOWARD A TARGET, which was filed on Jan. 11, 2011, and which is hereby incorporated by reference herein in its entirety.

GOVERNMENT RIGHTS

This invention was not made with United States Government support. The United States Government does not have certain rights in this invention.

TECHNICAL FIELD

Some embodiments pertain to a system and method for delivering a projectile toward a target.

BACKGROUND

Conventional projectile delivery systems typically utilize propulsion technologies such as casted grains or liquid propellants. Both casted grains and liquid propellants are costly as well as hazardous. In addition, casted grains and liquid propellants present a relatively large risk during storage such that some potential customers may not have the infrastructure necessary to store and prepare these devices for use in the field.

Therefore, a general need exists for low cost, safe-to-use and non-hazardous projectile delivery systems and methods. The projectile delivery systems and methods should also be able to be conveniently moved and stored before use in the field.

SUMMARY

Some embodiments relate to a system for delivering a projectile toward a target. The system includes a launcher and a propulsion system positioned within the launcher. The propulsion system includes a gas generator that produces enough gas within a certain period of time to direct the projectile from the launcher toward the target.

The system for delivering a projectile may further include a targeting system that collects data regarding the location of the target. In addition, the launcher may include a venting system that exhausts a particular amount of gas from the launcher in order to direct the projectile from the launcher at a desired velocity based on data received from the targeting system.

Some embodiments relate to method of directing a projectile toward a target. The method includes firing the projectile from within a launcher by using a gas generator to produce enough gas within a certain period of time inside the launcher to direct the projectile from the launcher toward the target.

The method may further include obtaining a location of the target using a targeting system. In addition, firing the projectile from within the launcher may include using a venting system to exhaust a particular amount of gas from the launcher in order to direct the projectile from the launcher at a desired velocity based on data received from the targeting system.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
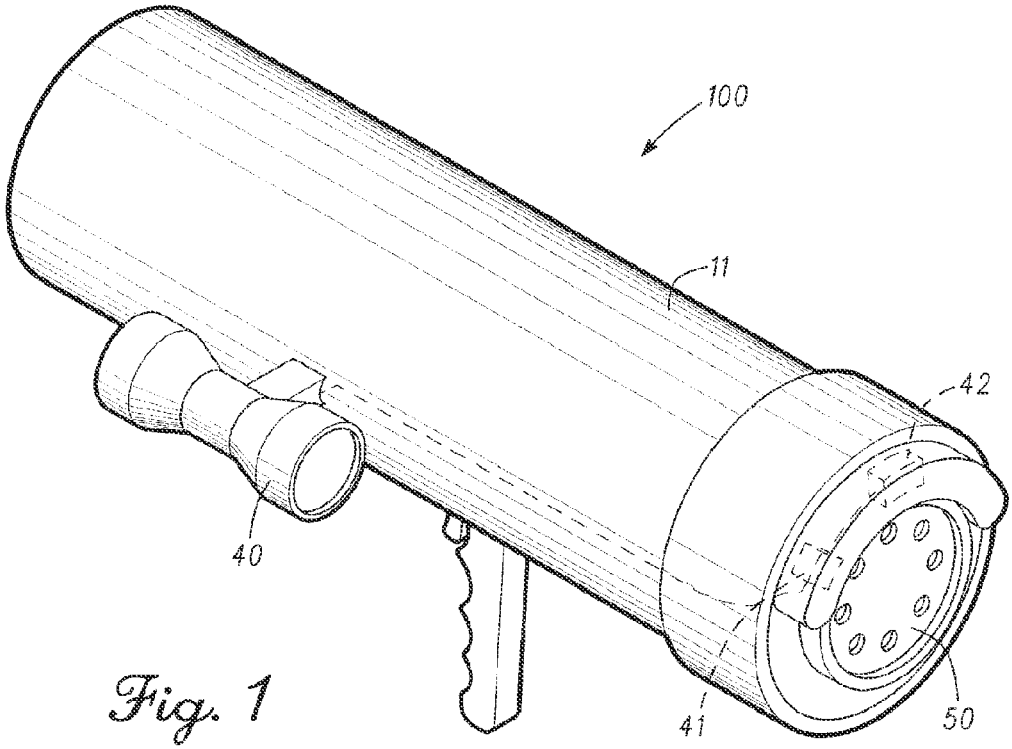
FIG. 1 is a perspective view of a system for delivering a projectile toward a target in accordance with some embodiments.
Figure 2:
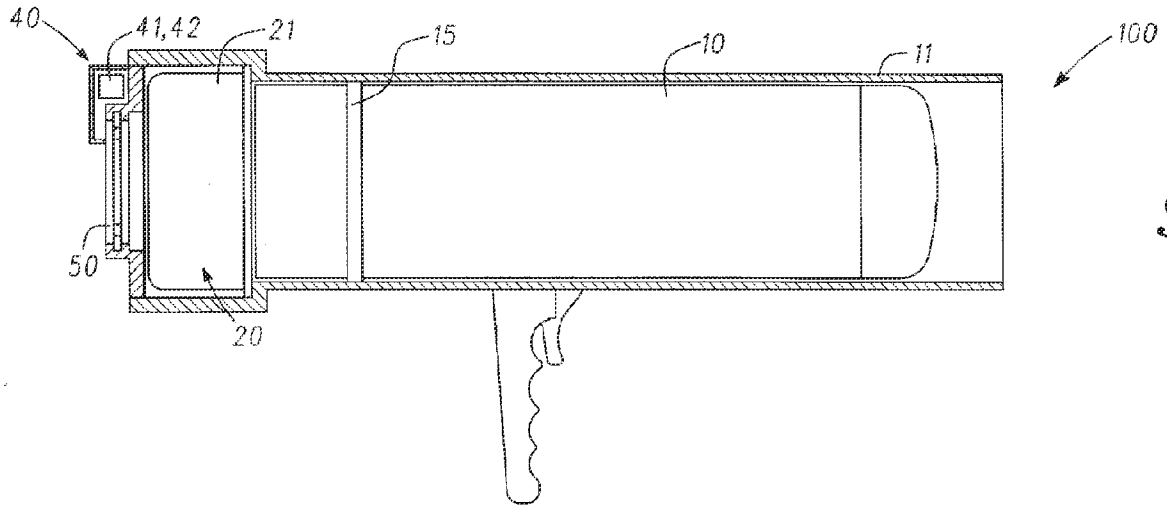
FIG. 2 is a section view of the system for delivering a projectile toward a target shown in FIG. 1 before the system has launched the projectile.
Figure 3:
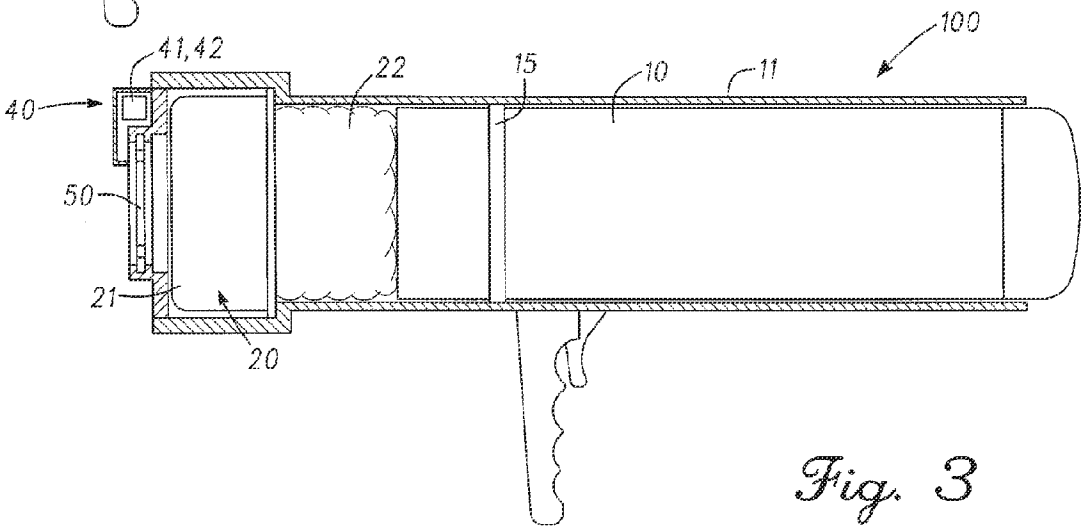
FIG. 3 is a section view similar to FIG. 2 showing the system just after the system has begun to launch the projectile.
Figure 4:
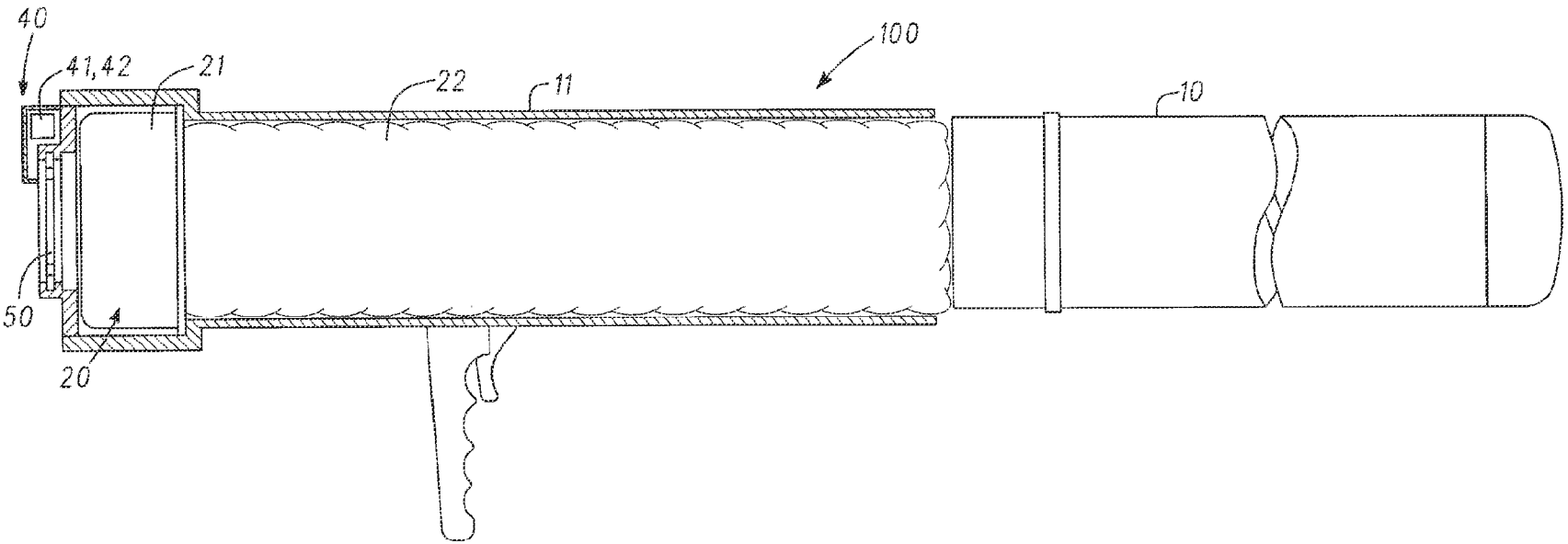
FIG. 4 is a section view similar to FIGS. 2 and 3 showing the system just after the projectile has exited the launcher.

FIG. 1 is a perspective view of a system 100 for delivering a projectile 10 toward a target in accordance with some embodiments. FIG. 2 is a section view of the system for delivering a projectile 10 toward a target shown in FIG. 1 before the system has launched the projectile 10. FIG. 3 is a section view similar to FIG. 2 showing the system just after the system has begun to launch the projectile 10. FIG. 4 is a section view similar to FIGS. 2 and 3 showing the system just after the projectile 10 has exited the system 100.

The system 100 includes a launcher 11 and a propulsion system 20 positioned within the launcher 10. The propulsion system includes a gas generator 21 that produces enough gas 22 (see FIG. 3) within a certain period of time to direct the projectile 10 from the launcher 10 toward the target (not shown in FIGS. 1-4).

In some embodiments, the projectile 10 is a canister that includes an entrapment device. In this type of embodiment, the system 100 delivers a non-lethal projectile 10. In other embodiments, the projectile 10 includes explosive ordinance.

The type of projectile 10 that is delivered by the system 100 will depend in part on (i) the application where the system 100 is to be used; (ii) the size of the launcher 11; and/or (iii) the range to the target (among other factors).

As shown in FIG. 1, the system 100 may further include a targeting system 40 that collects data regarding the location of the target. The type and location of the targeting assembly 40 that is used with the system 100 will depend in part on the desired budget to produce the system 100 as well as the application where the system 100 is to be used.

As an example, the targeting system 40 may include a device that is used to assist in aiming the system 100 by aligning an eye of a person using the system 100. The device may be configured to align the system 100 relative to the target. Some example optical devices include, but are not limited to, video cameras, laser sights, reflex sights, peep sights, telescopic sights, and other sighting devices.

Figure 5:
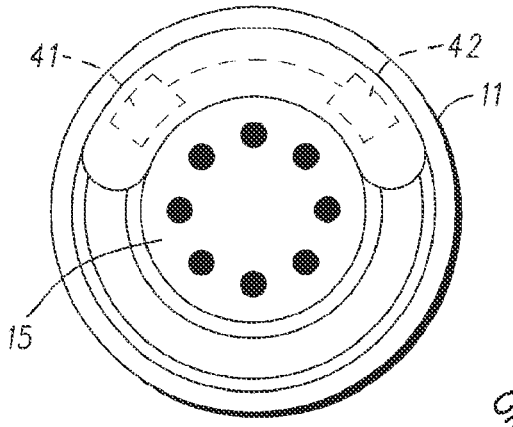
FIG. 5 is a rear plan view of the example system for delivering a projectile shown in FIG. 1 where the illustrated venting system is in a closed position.
Figure 7:
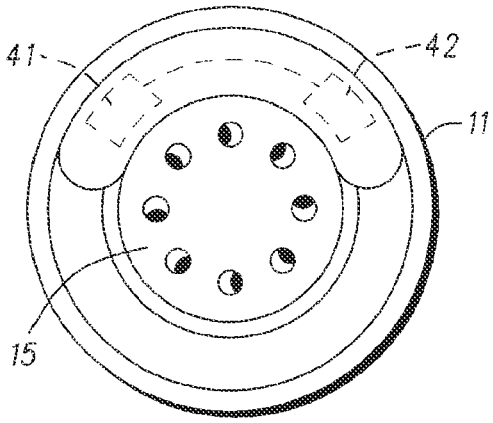
FIG. 7 is a rear plan view similar to FIG. 5 showing the system where the illustrated venting system is in a partially open position.
Figure 9:
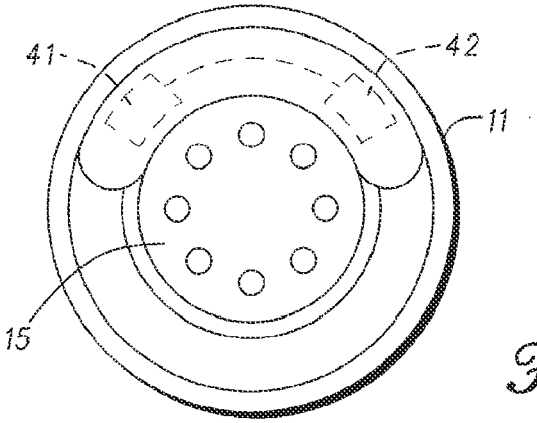
FIG. 9 is a rear plan view similar to FIGS. 5 and 7 showing the system where the illustrated venting system is in a fully open position.

As shown most clearly in FIGS. 5, 7 and 9, the launcher 11 may include a venting system 50 that exhausts a particular amount of gas from the launcher 11 in order to direct the projectile 10 from the launcher 10 at a desired velocity based on data received from the targeting system 40.

Figures 6, 8, 10:
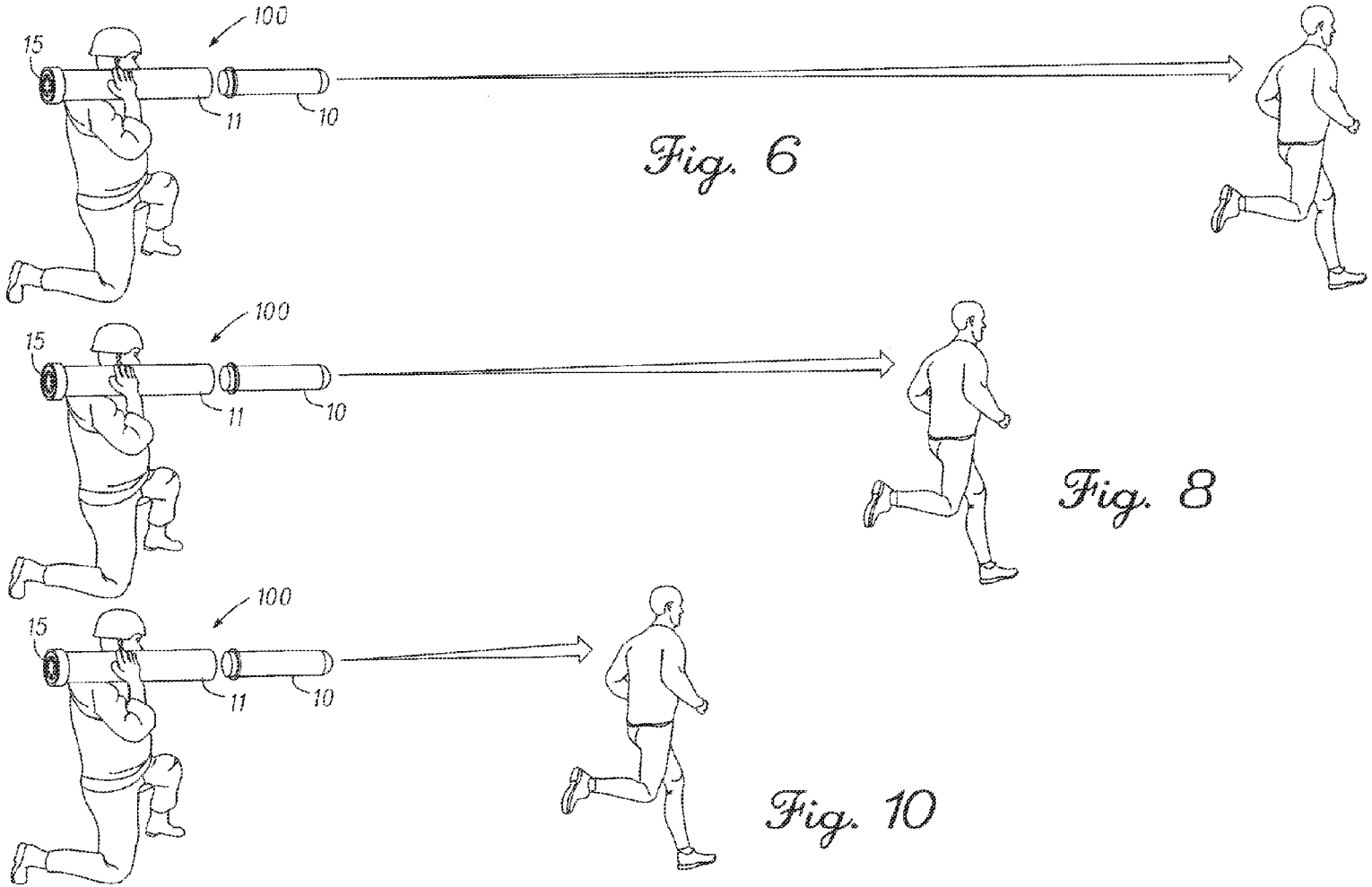
FIG. 6 is a side view showing the system launching the projectile when the venting system is in the position shown in FIG. 5.
FIG. 8 is a side view similar to FIG. 6 showing the system launching the projectile when the venting system is in the position shown in FIG. 7.
FIG. 10 is a side view similar to FIGS. 6 and 8 showing the system launching the projectile when the venting system is in the position shown in FIG. 9.

FIG. 5 is a rear plan view of the example system 100 for delivering a projectile shown in FIG. 1 where the illustrated venting system 50 is in a closed position. FIG. 6 is a side view showing the system 100 launching the projectile 10 when the venting system 50 is in the closed position shown in FIG. 5. As illustrated in FIG. 6, the projectile 10 will exit the launcher 11 at the maximum possible velocity (and therefore travel the greatest possible distance) because all of the gas that is generated by the gas generator 21 is used to propel the projectile 10 when the vents in the venting system 50 are closed.

FIG. 7 is a rear plan view of the example system 100 for delivering a projectile shown in FIG. 1 where the illustrated venting system 50 is in a partially open position. FIG. 8 is a side view showing the system 100 launching the projectile 10 when the venting system 50 is in the partially open position shown in FIG. 7. As illustrated in FIG. 8, the projectile 10 will exit the launcher 11 at less than the maximum possible velocity (and therefore travel less than the greatest possible distance) because some of the gas that is generated by the gas generator 21 is vented through the venting system 50 instead of being used to propel the projectile 10.

FIG. 9 is a rear plan view of the example system 100 for delivering a projectile shown in FIG. 1 where the illustrated venting system 50 is in a fully open position. FIG. 10 is a side view showing the system 100 launching the projectile 10 when the venting system 50 is in the fully open position shown in FIG. 9. As illustrated in FIG. 10, the projectile 10 will exit the launcher 11 at a minimum velocity (and therefore travel the smallest possible distance) because as much of the gas as possible that is generated by the gas generator 21 is vented through the venting system 50 instead of being used to propel the projectile 10.

It should be noted that amount of gas that is generated by the gas generator 21 may be able to be tightly controlled depending on the type of gas generator 21 that is used in the system 100. As an example, the gas generator 21 may be a gas generator that is used in air-bag technology.

In one example embodiment, an automotive airbag inflator system (without the airbag) can be used to generate enough gas to propel a projectile to a distance of 5 to 50 meters with an exit velocity of 70 to 80 meters/second. The difference in the exit velocities is due to the changing mass of the projectile. The higher the mass, the lower the exit velocity. Since the amount of generated gas by the inflator has been verified via testing to be consistent, the exit velocity may be established by "venting" a particular amount of gas so that a known amount is used to propel the projectile at a pre-determined exit velocity.

Embodiments are contemplated where the gas generator includes more than one device. As an example, a dual gas generator propulsion system may be used to increase the amount of gas that is use to propel the projectile 10. The dual gas generator propulsion system may increase the exit velocity and therefore increase the targetable range of the system 100.

In some embodiments, the targeting system 40 includes a sensor 41 that is configured to sense the location of the target and a propulsion designation module 42 that determines an appropriate exit velocity of the projectile 10 upon launching the projectile 10 based on data received from the sensor 41.

As an example, the propulsion designation module 42 may identify the appropriate exit velocity based on the distance and elevation of the system 100 relative to the target. The sensor 41 may also collect other data such as wind, temperature and humidity (among other factors) which may be used to by the propulsion designation module 42 to identify the appropriate exit velocity.

In some embodiments, the projectile 10 may include an obturator 15 and/or a pressure cup (not shown). As shown in FIG. 2, when the projectile 10 includes an obturator 15, the venting system 50 and the propulsion system 20 are located on the same side of the obturator 15 when the projectile 10 is loaded into the launcher 11. Although the venting system 50 is shown in the illustrated embodiments as having the vents in the back of the launcher 11, the vents may be in other parts of the launcher (e.g., the sides) as long the venting system 50 is able to allow a desired amount of gas to escape.

In some embodiments, the launcher 11 may include a barrel having interior rifling that induces a rotation to the projectile 10 as the projectile 10 travels through the launcher 11. The gas generator 21 produces enough gas within a certain period of time in order to overcome friction caused by the interior rifling in the barrel and directs the projectile 10 from the launcher 11 toward the target.

Although the launcher 11 is illustrated in the example embodiments as being a shoulder-mounted launcher, it should be noted that the system 100 may include any type of launcher. As examples, the launcher 11 may be a tripod-mounted launcher, gimbal-based assemblies or turret-mounted launchers (among other devices).

Figure 11:
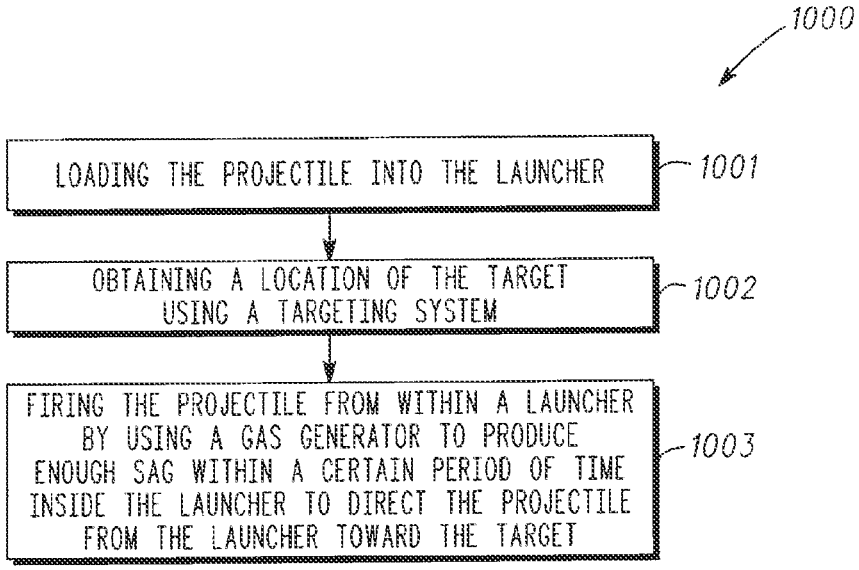
FIG. 11 is a flow diagram illustrating a method of delivering a projectile toward a target in accordance with some embodiments.

FIG. 11 is a flow diagram illustrating a method 1000 of delivering a projectile 10 toward a target in accordance with some embodiments. The method 1000 includes firing the projectile 10 from within a launcher 11 by using a gas generator 21 to produce enough gas within a certain period of time inside the launcher 11 to direct the projectile 10 from the launcher 11 toward the target as shown in box 1003.

The type of projectile 10 that is launched using the method 1000 will depend in part on the application where the method 1000 is being used. As an example, firing the projectile 10 from within the launcher 11 as shown in box 1003 may include firing a canister that houses an entrapment device from the launcher 11 toward a human target.

The method 1000 may further include loading the projectile into the launcher as shown in box 1001 and obtaining a location of the target using a targeting system as shown in box 1002.

In some embodiments, firing the projectile from within the launcher as shown in box 1003 may include using a venting system to exhaust a particular amount of gas from the launcher in order to direct the projectile from the launcher at a desired velocity based on data received from the targeting system. As an example, using the venting system may include adjusting the venting system in order to direct the projectile from the launcher at a desired velocity.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, the embodiments of the invention may lie in less than all features of a single disclosed embodiment. Thus the following claims are hereby incorporated into the detailed description, with each claim standing on its own as a separate embodiment.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of embodiments of the invention(s). In general, structures and functionality presented as separate components in the exemplary configurations may be implemented as a combined structure or component. Similarly, structures and functionality presented as a single component may be implemented as separate components. These and other variations, modifications, additions, and improvements fall within the scope of embodiments of the invention (s).

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A system for delivering a projectile toward a target, the system comprising:

a launcher; and a propulsion system positioned within the launcher, the propulsion system including a gas generator that produces enough gas within a certain period of time to direct the projectile from the launcher toward the target, wherein the launcher includes an adjustable venting system that exhausts a particular amount of gas from the launcher in order to direct the projectile from the launcher at a desired velocity.

2. The system of claim 1 wherein the projectile is a canister that includes an entrapment device.

3. The system of claim 1 wherein the projectile includes explosive ordinance.

4. The system of claim 1 further comprising a targeting system that collects data regarding the location of the target.

5. The system of claim 4 wherein the launcher includes a venting system that exhausts a particular amount of gas from the launcher in order to direct the projectile from the launcher at a desired velocity based on data received from the targeting system.

6. The system of claim 5 wherein the targeting system includes a sensor configured to sense the location of the target.

7. The system of claim 6 wherein the targeting system includes a propulsion designation module that determines an appropriate exit velocity of the projectile upon launching the projectile based on data received from the sensor.

8. The system of claim 7 wherein the propulsion designation module identifies the appropriate exit velocity based on the distance and elevation of the system relative to the target.

9. The system of claim 4 wherein the projectile includes an obturator.

10. The system of claim 9 wherein the venting system and the propulsion system are located on the same side of the obturator when the projectile is loaded into the launcher.

11. The system of claim 1 wherein the launcher includes a barrel having interior rifling that induces a rotation to the projectile as the projectile travels through the launcher.

12. The system of claim 11 wherein the gas generator produces enough gas within a certain period of time in order to overcome friction caused by the interior rifling in the barrel and directs the projectile from the launcher toward the target.

13. A method of directing a projectile toward a target, the method comprising firing the projectile from within a launcher by using a gas generator to produce enough gas within a certain period of time inside the launcher to direct the projectile from the launcher toward the target, wherein using a venting system to exhaust a particular amount of gas from the launcher includes adjusting the venting system in order to direct the projectile from the launcher at a desired velocity.

14. The method of claim 13 further comprising loading the projectile into the launcher.

15. The method of claim 13 further comprising obtaining a location of the target using a targeting system.

16. The method of claim 15 wherein firing the projectile from within the launcher includes using a venting system to exhaust a particular amount of gas from the launcher in order to direct the projectile from the launcher at a desired velocity based on data received from the targeting system.

17. The method of claim 13 wherein firing the projectile from within the launcher includes firing a canister that houses an entrapment device from the launcher toward a human target.

18. A projectile delivery system configured to fire a projectile from within a launcher by using a gas generator to produce enough gas within a certain period of time inside the launcher to direct the projectile from the launcher toward the target, wherein the projectile delivery system is configured to use an adjustable venting system to exhaust a particular amount of gas from the launcher in order to direct the projectile from the launcher at a desired velocity.

* * * * *